US005934951A

United States Patent [19]

Lai et al.

[11] Patent Number: 5,934,951

[45] Date of Patent: Aug. 10, 1999

[54] ANTI-WICKING CONDUCTIVE CONTACT FOR AN ELECTRICAL CONNECTOR

[75] Inventors: Ching-ho Lai, Tao Yuan Hsien; Cheng-Hong Lin, Chung-Ho, both of Taiwan

[73] Assignee: Hon Hai Precision Ind. Co., Ltd., Taipei Hsien, Taiwan

[21] Appl. No.: 08/897,889

[22] Filed: Jul. 22, 1997

[30] Foreign Application Priority Data

Aug. 8, 1996 [TW] Taiwan ..... 85212188

[51] Int. Cl.[6] ..... H01R 13/629

[52] U.S. Cl. ..... 439/876

[58] Field of Search ..... 439/83, 330, 259, 439/261, 876, 89, 879

[56] References Cited

U.S. PATENT DOCUMENTS

| | | | |
|---|---|---|---|
| 5,209,681 | 5/1993 | Brown | 439/876 |
| 5,395,250 | 3/1995 | Englert, Jr. et al. | 439/876 |
| 5,489,218 | 2/1996 | McHugh | 439/259 |
| 5,692,920 | 12/1997 | Banakis et al. | 439/259 |

*Primary Examiner*—Gary F. Paumen
*Assistant Examiner*—Alexander Gilman

[57] ABSTRACT

A conductive contact for an electrical connector is disclosed. The conductive contact comprises a lower inserting section for inserting into an external circuit board, an upper contacting section for engaging a mating lead pin of a chip, a middle fixing section for fixing onto a cooperating housing for an electrical connector, and anti-wicking means for prevention of wicking during wave soldering procedure. The anti-wicking means can be an inverted V-shaped groove formed on the fixing section or a horizontal plate stamped from the fixing section. The conductive contact can be formed by stamping and bending.

8 Claims, 8 Drawing Sheets

ANTI-WICKING CONDUCTIVE CONTACT FOR AN ELECTRICAL CONNECTOR

BACKGROUND OF THE INVENTION

1. Field of the Invention

The invention relates to a conductive contact for an electrical connector, particularly to an anti-wicking conductive contact.

2. The Prior Art

A conventional conductive contact 3 is shown in FIG. 1. The conductive contact 3 generally comprises a lower inserting section 32 for inserting into an external circuit board, an upper contacting section 30 for engaging a mating lead pin of a chip, and a middle fixing section 31 having barbs 310 for interferingly fitting onto a housing 40 for an electrical connector. For facilitating the insertion of the contact 3 into a contact receiving hole 401 of the housing 40, usually a relatively large hole 401 is formed on the housing 40. However, there will be a relatively large gap T remained between the contact 3 and the inner walls of the hole 401 when the contact 3 is inserted into the hole 401, which causes wicking of molten solder and flux during wave soldering. An improved hole design of the housing was proposed to solve the above-mentioned problem. A floor 41 is provided in the hole 401, extending laterally from a bottom of the inner wall of the hole 401, to diminish the gap T of hole 401. This structural variation of the hole 401 requires the variation of the assembling process—to mount the contact 3 from top of the hole 401, which needs larger hole 401 than it was. Thus, the wicking problem still occurs in some critical conditions.

Hence, there is a need for an anti-wicking conductive contact that can overcome the above-mentioned problems.

SUMMARY OF THE INVENTION

Accordingly, one main object of the present invention is to provide a conductive contact having means for prevention of wicking during wave soldering procedure.

To fulfill the above-mentioned objects, according to one embodiment of the present invention, a conductive contact for an electrical connector comprises a lower inserting section for inserting into an external circuit board, an upper contacting section for engaging a mating lead pin of a chip, a middle fixing section for fixing onto a cooperating housing for an electrical connector, and anti-wicking means for prevention of wicking during wave soldering procedure.

These and additional objects, features, and advantages of the present invention will be apparent from a reading of the following detailed description of the embodiments of the invention taken in conjunction with the appended drawing figures, which are described briefly immediately below.

DETAILED DESCRIPTION OF THE PREFERRED EMBODIMENTS

Figure 1:
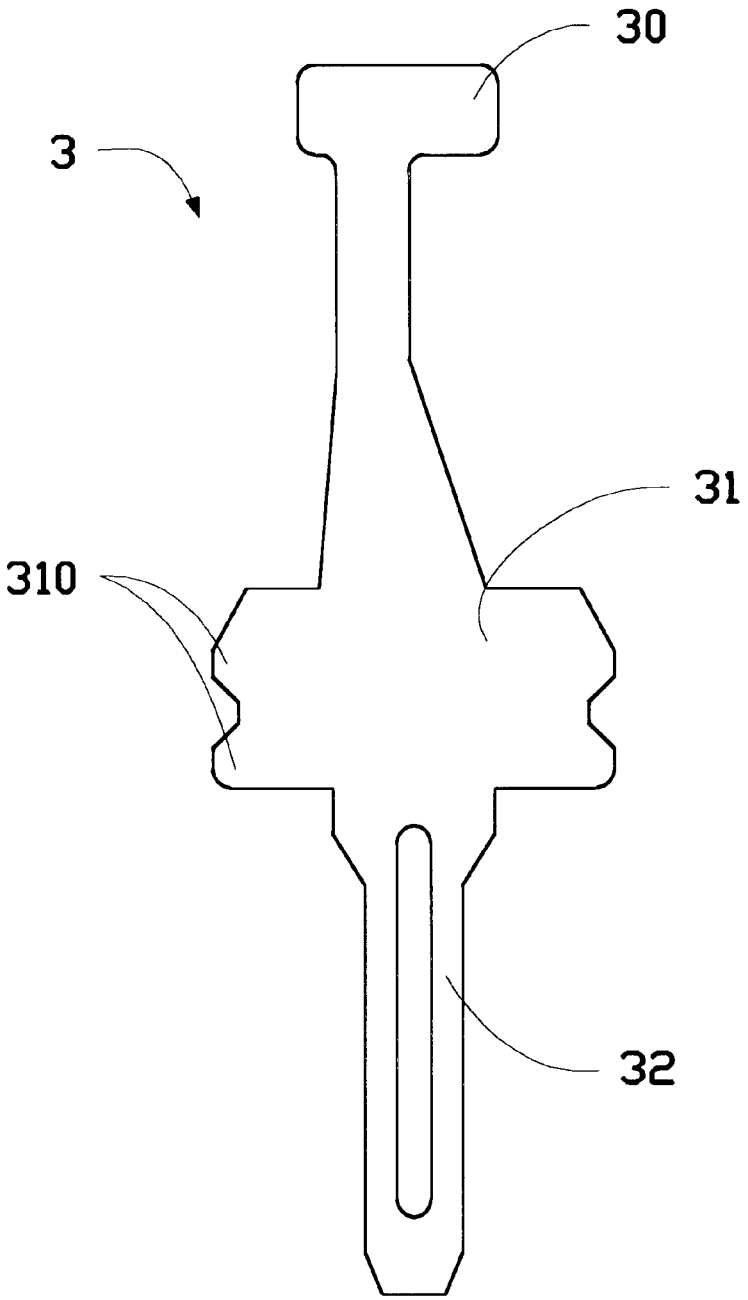
FIG.1 (PRIOR ART)
FIG. 1 is a perspective view of a conventional conductive contact.
Figure 2:
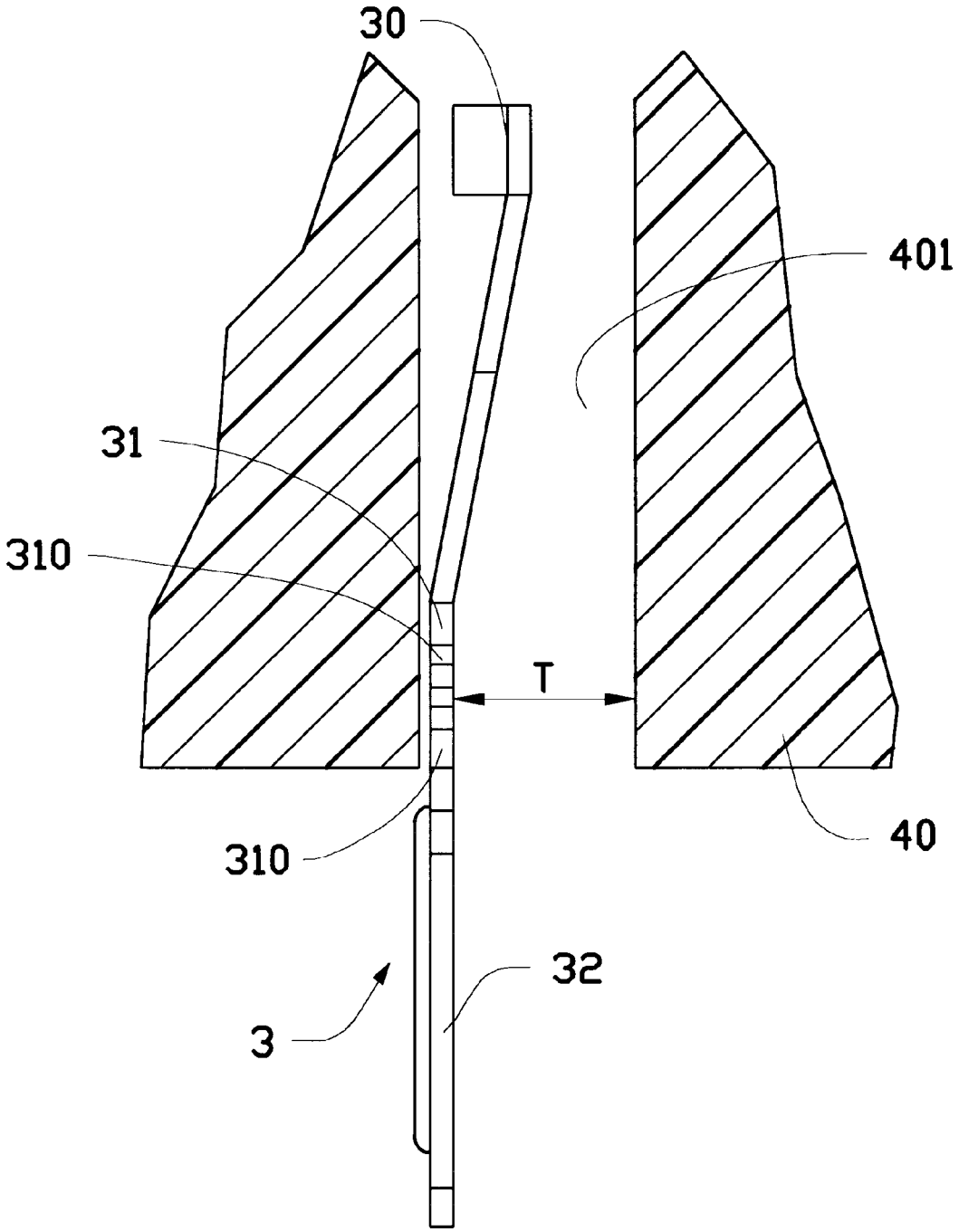
FIG.2 (A) (PRIOR ART)
FIG. 2A shows an arrangement of the conductive contact of FIG. 1 in a conventional housing hole.
FIG. 2B shows an arrangement of the conductive contact of FIG. 1 in another conventional housing hole.
Figure 2:
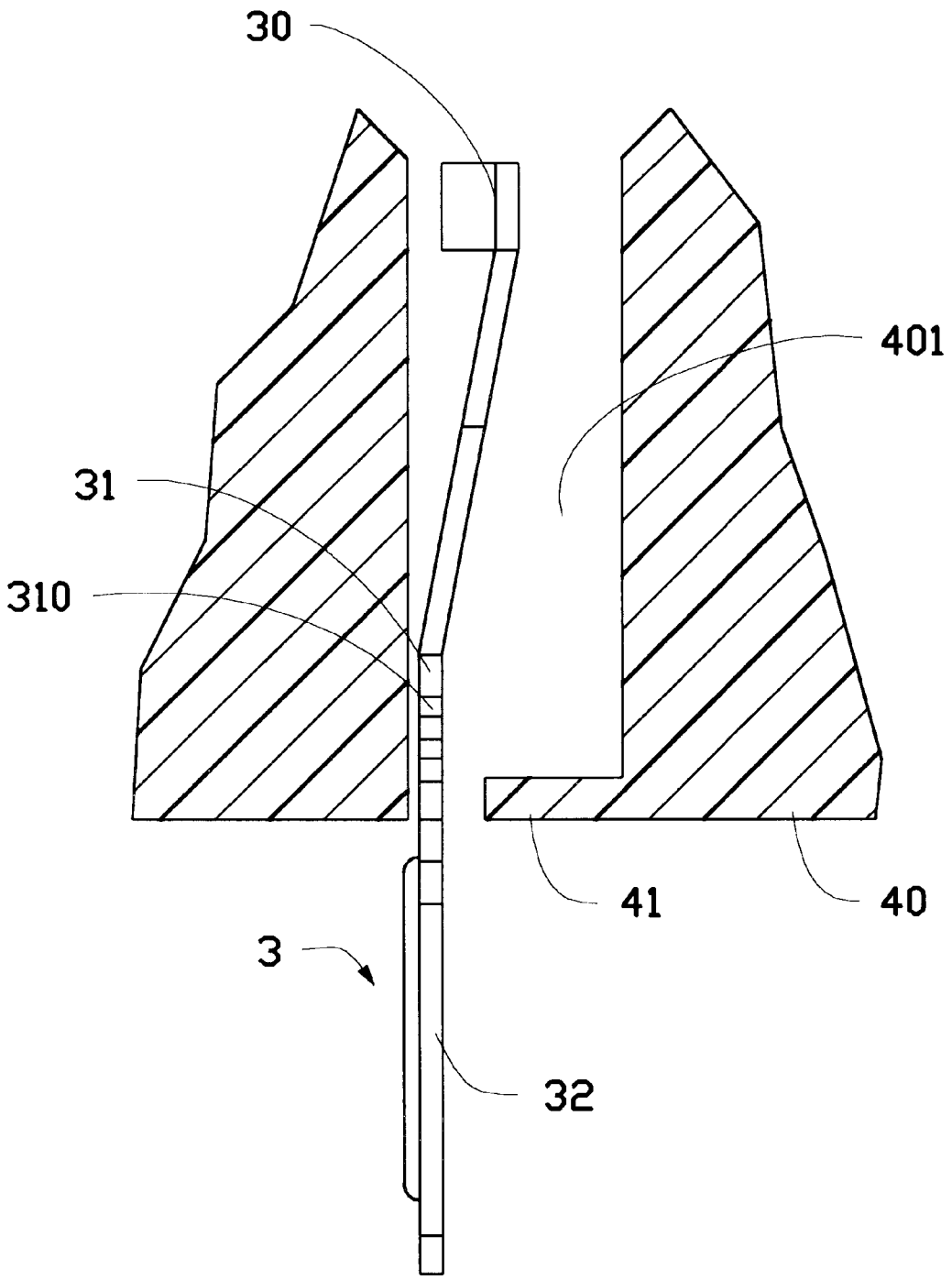
FIG.2 (B) (PRIOR ART)

Reference will now be made in detail to the preferred embodiments of the present invention. It will be noted here that for a better understanding, most of like components are designated by like reference numerals throughout the various figures in the embodiments.

Figure 3:
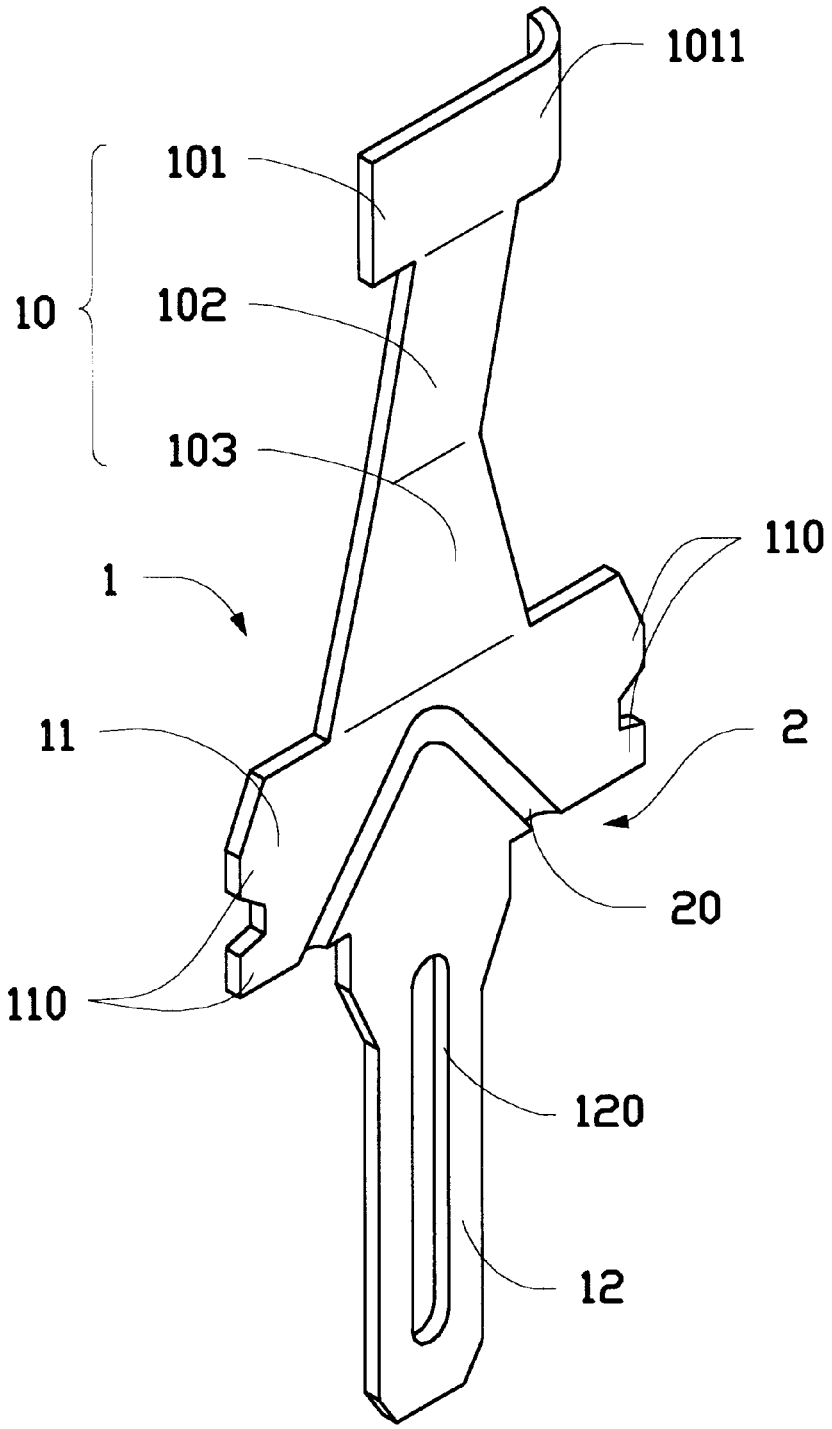
FIG. 3A shows a perspective view of an anti-wicking conductive contact according to one embodiment of the present invention.
FIG. 3B shows an arrangement of the conductive contact of FIG. 3A in a conventional housing hole.
Figure 3:
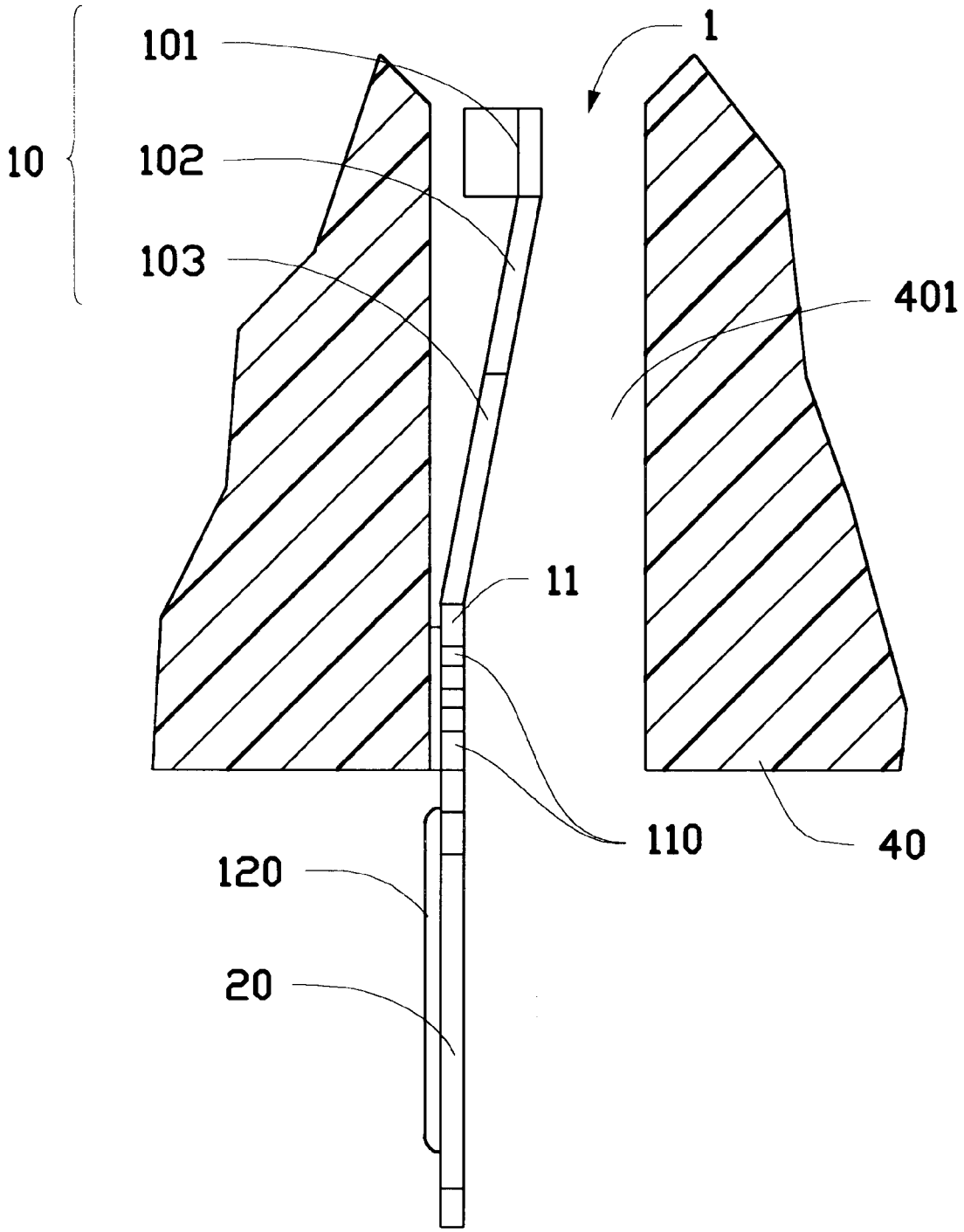

Referring now to FIG. 3A, a conductive contact according to the present invention is generally designated at 1. The conductive contact 1 mainly comprises a lower inserting section 12 for inserting into an external circuit board, an upper contacting section 10 for engaging a mating lead pin of a chip (not shown), a middle fixing section 11 for fixing onto a housing 40 for an electrical connector (not shown), and anti-wicking means 2 for prevention of wicking during wave soldering procedure.

The contacting section 10 includes a contacting portion 101 for mating with a mating lead pin of a chip (not shown), a neck portion 102 extending downward from a lower edge of the contacting portion 101, and a transition portion 103 extending downward from a lower edge of the neck portion 102 for transiting into the fixing section 11.

The contacting portion 101 has a width wider than the neck portion 102 and comprises a deflected lateral end 1011 for guiding the entrance of the mating lead pin of a chip. The neck portion 102 is substantially a vertically elongate plate which serves as a spring piece for the contacting portion 101. The transition portion 103 has a width increasing gradually from an upper portion to a lower portion and thus provides a strong connection to the fixing section 11. Referring also to FIG. 3B, the neck portion 102 and transition 103 incline relative to the contacting portion 101 and the fixing section 11 to facilitate mounting into a contact receiving hole 401 of a cooperating housing 40.

The fixing section 11, connected by an upper edge thereof with the transition portion 103 of the contacting section 10, is substantially a transverse plate relative to the length of the contact. The fixing section 11 includes fixing means 110 thereon for fixing onto a housing 40 for an electrical connector. In one embodiment, the fixing means 110 includes barbs on both lateral edges of the fixing section 11 for interferingly fitting into a wall of the contact receiving hole 401.

The inserting section 12 is substantially a vertically elongate plate extending from a lower edge of the fixing section 11. The inserting section 12 comprises an elongate rib 120 stamped on a central portion thereof for increasing its strength during inserting into a circuit board.

The anti-wicking means 2 shown in the embodiment of FIGS. 3A and 3B comprises an inverted V-shaped groove 20 formed on a surface of the fixing section 11. The two branches of the inverted V-shaped groove 20 extend from a peak thereof near a central portion of the fixing section 11 to two separate notches on bottom edges thereof. After wave soldering procedure, the molten solder and flux entering the contact receiving hole 401 will flow out off the hole 401 along the inverted V-shaped groove 20. In one preferred embodiment, the inverted V-shaped groove 20 is stamped on the surface.

Figure 4:
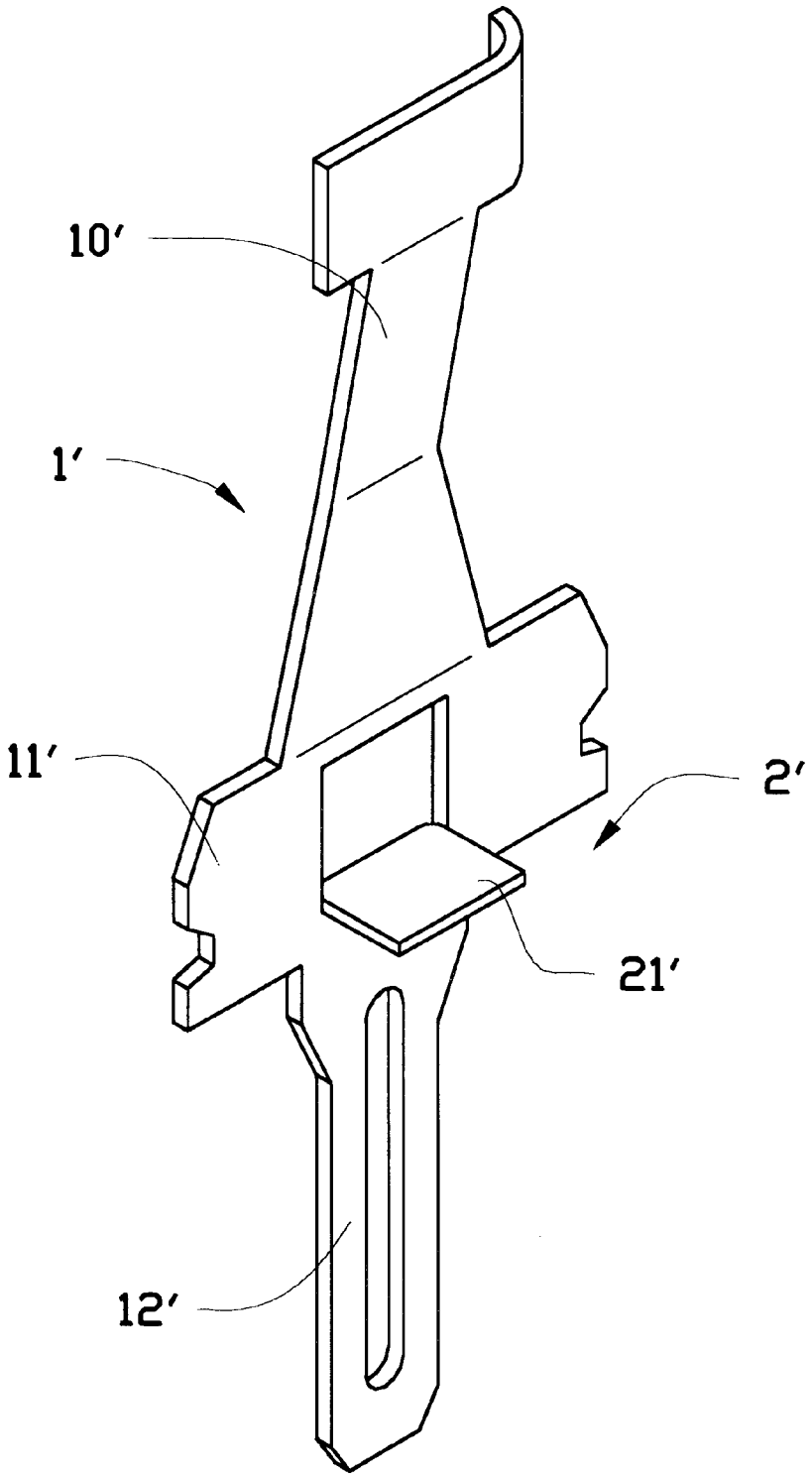
FIG. 4A shows a perspective view of an anti-wicking conductive contact according to a second embodiment of the present invention.
FIG. 4B shows an arrangement of the conductive contact of FIG. 4A in a conventional housing hole.
Figure 4:
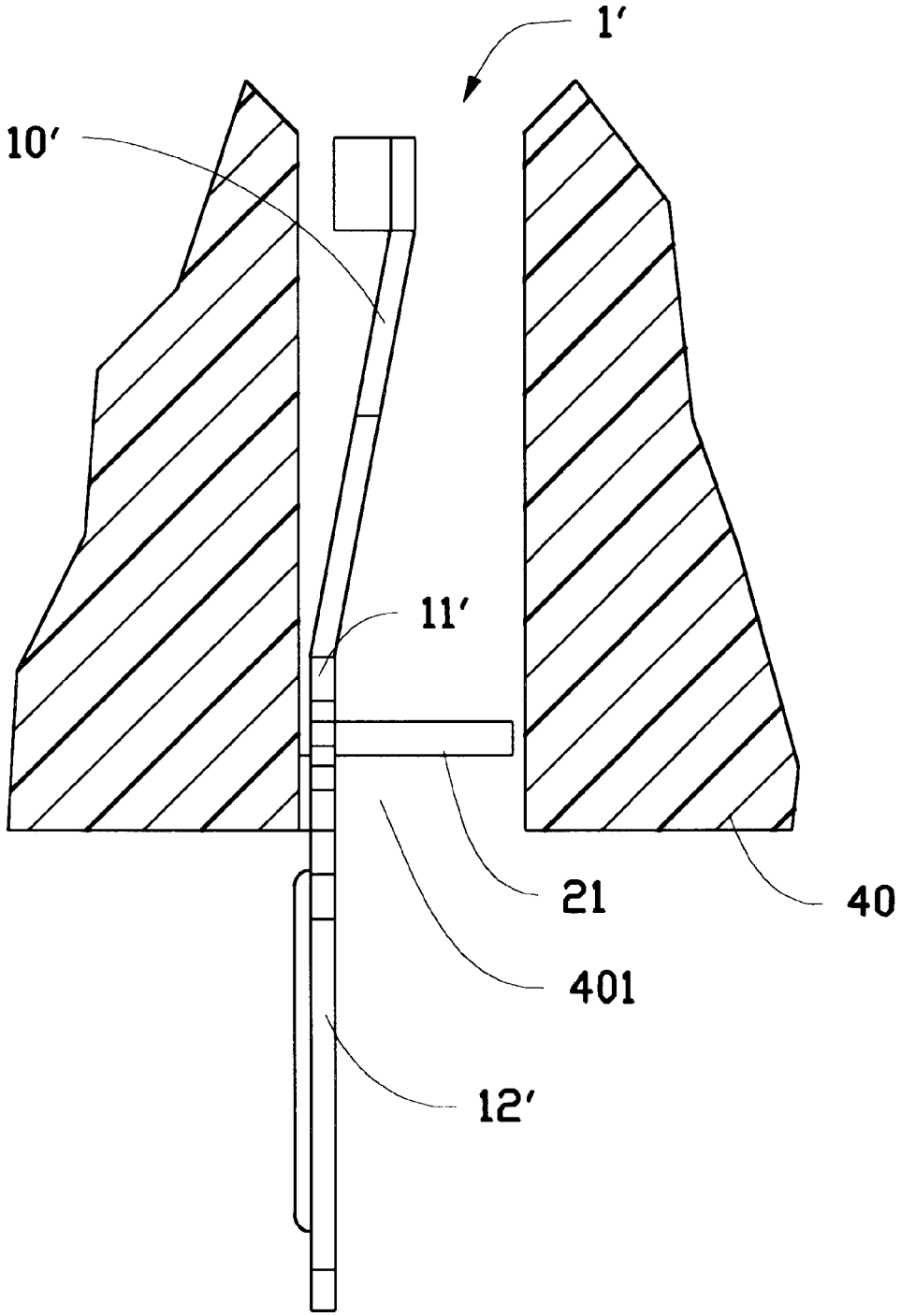

FIGS. 4A and 4B show a second embodiment of the anti-wicking means 2' according to the present invention. In this embodiment, the anti-wicking means 2' comprises a horizontal plate 21 stamped out from a central portion thereof. As can be seen in FIG. 4B, the horizontal plate 21 serves as a sealing member and snugly seals a lower portion of the contact receiving hole 401 for prevention of wicking of molten solder and flux into the hole 401.

Figure 5:
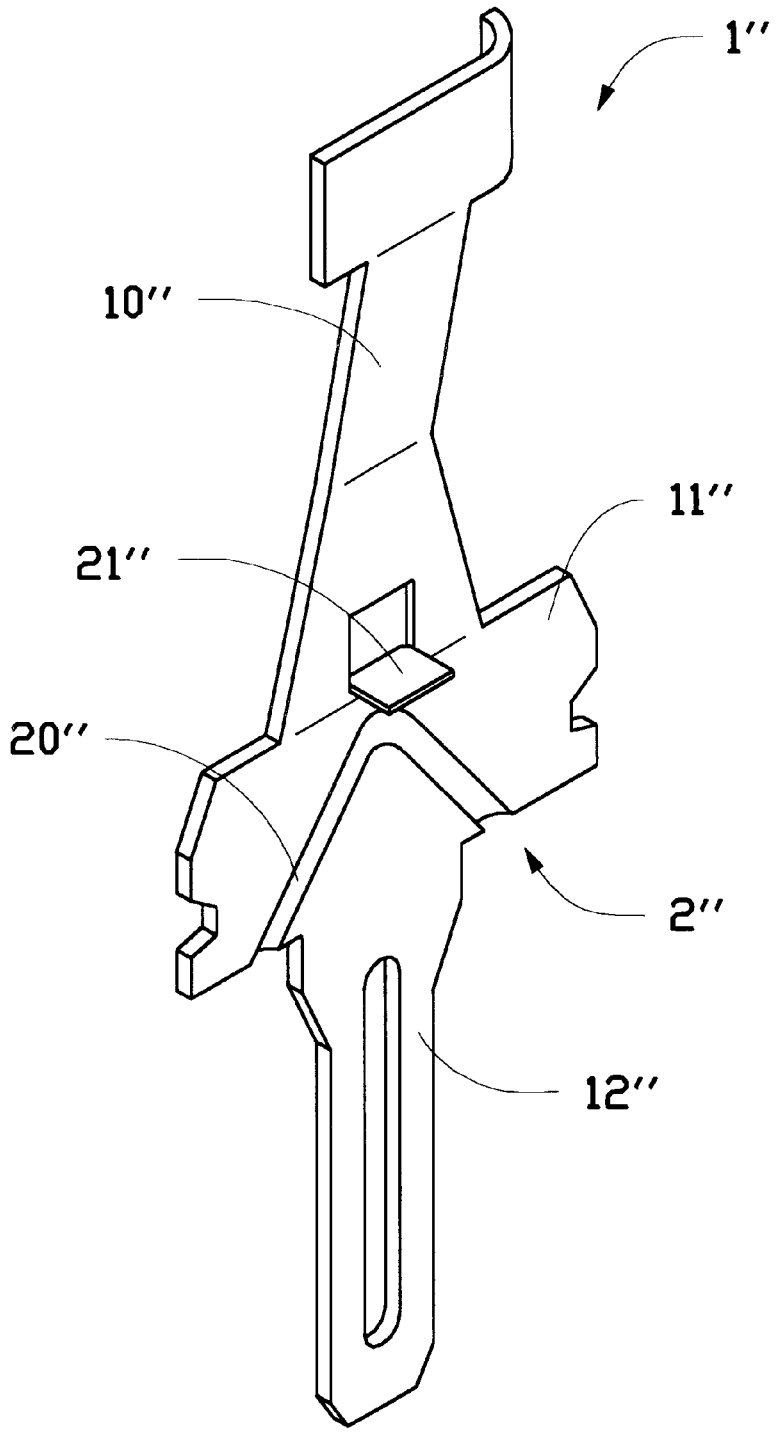
FIG. 5 shows a perspective view of an anti-wicking conductive contact according to a third embodiment of the present invention.

FIG. 5 shows a third embodiment of the anti-wicking means 2" according to the present invention. In this embodiment, the anti-wicking means 2" comprises an inverted V-shaped groove 20" formed on a surface of the fixing section 11 and a horizontal plate 21" stamped above the inverted V-shaped groove 20". The manufacturing, structure and function of the inverted V-shaped groove 20" are the same as those of the inverted V-shaped groove 20 of the first embodiment mentioned above, and the manufacturing, structure and function of the horizontal plate 21" are the same as those of the horizontal plate 21 of the second embodiment mentioned above. Therefore, the advantages of anti-wicking means 2 and 2' in the first and the second embodiments, respectively, are merged into the present embodiment. In one preferred embodiment, the conductive contact 1, 1' and 1" are all manufactured by stamping and bending as a unitary member.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

We claim:

1. A conductive contact for an electrical connector, comprising:

a lower inserting section for inserting into an external circuit board;

an upper contacting section for engaging a mating lead pin of a chip;

a middle fixing section for fixing onto a cooperating housing of an electrical connector; and anti-wicking means formed on the fixing section and including at least a groove extending along an oblique direction from proximate the contacting section to proximate the inserting section for prevention of wicking during wave soldering procedure by guiding a downward and lateral flow of solder and flux wicked upward along the lower inserting section.

2. The conductive contact for the electrical connector as claimed in claim 1, wherein said anti-wicking means further comprises at least one horizontal plate formed above the at least one groove for blocking an upward movement of solder and flux.

3. The conductive contact for the electrical connector as claimed in claim 1, wherein said at least one groove includes an inverted V-shaped groove.

4. A connector having means for preventing solder wicking comprising:

a connector housing;

a contact in said housing, said contact including a lower insertion section for inserting into an external circuit board, an upper contacting section for engaging a mating contact of an electrical component, and a middle fixing section fixed into a receiving hole in the connector housing; and a plate integrally split from the middle fixing section and downwardly bent to a horizontal position adjacent to a bottom of the connector housing so as to cover most portions of a cross-section of said hole.

5. A connector containing anti-wicking mechanism comprising:

a connector housing with a plurality of contact holes, a plurality of contacts received in the respective contact holes, each of said contacts including a lower insertion section for inserting into an internal circuit board and a fixing section integrally formed above said insertion section, wherein a bottom edge of the fixing section lies flush with a bottom surface of the connector;

an inverted V-shaped groove disposed in said fixing section along a full vertical dimension of said fixing section, the groove having two distal ends communicating with the bottom edge of the fixing section.

6. The conductive contact for the electrical connector as claimed in claim 1, wherein the at least one groove is disposed along substantially a full vertical dimension of the fixing section and has two distal ends extending to a bottom edge of the fixing section.

7. The conductive contact for the electrical connector as claimed in claim 1, wherein the at least one groove has two distal ends located beyond two opposite lateral edges of the inserting section.

8. The conductive contact for the electrical connector as claimed in claim 1, wherein the at least one groove interrupts a fluid communication relationship between the lower inserting section and the upper contacting section.

* * * * *